US006431034B1

(12) United States Patent
Chen

(10) Patent No.: US 6,431,034 B1
(45) Date of Patent: Aug. 13, 2002

(54) TOOL HANDLE HAVING A COMPLETELY OPENABLE CONFIGURATION

(76) Inventor: Ying Wu Chen, No. 10, Lane 38, Li Der Street, Taiping City, Taichung Hsien (TW), 411

( * ) Notice: Subject to any disclaimer, the term of this patent is extended or adjusted under 35 U.S.C. 154(b) by 0 days.

(21) Appl. No.: 09/812,413

(22) Filed: Mar. 21, 2001

(51) Int. Cl.[7] ..... B25B 23/16

(52) U.S. Cl. ..... 81/177.4; 81/490; 81/124.4; 81/439

(58) Field of Search ..... 81/177.4, 177.6, 81/177.7, 124.4, 437–439, 490, 177.1, 177.2; 7/165

(56) References Cited

U.S. PATENT DOCUMENTS 5,704,260 A * 1/1998 Huang ..... 81/490
5,918,513 A * 7/1999 Ho ..... 81/490
5,992,626 A * 11/1999 Anderson ..... 81/177.4
6,216,858 B1 * 4/2001 Chiu ..... 81/177.4

* cited by examiner

*Primary Examiner*—D. S. Meislin
(74) *Attorney, Agent, or Firm*—Charles E. Baxley

(57) ABSTRACT

A tool device includes a base and a cover handle members having a front portion rotatably secured together and having a rear portion openable to a fully open position for allowing the tool members or tool extensions to be easily engaged into and disengaged from the handle members. The cover handle member includes a notch formed in the front portion for receiving a bulge extended from the front portion of the base handle member. A latch may be used for selectively latching the rear portions of the base and the cover handle members together.

7 Claims, 6 Drawing Sheets

TOOL HANDLE HAVING A COMPLETELY OPENABLE CONFIGURATION

BACKGROUND OF THE INVENTION

1. Field of the Invention

The present invention relates to a tool handle, and more particularly to a tool handle including a fully or completely openable configuration.

2. Description of the Prior Art

Typical tool handles, such as the handles of the screw drivers or wrenches, include a chamber formed in the handle, particularly formed in the rear portion of the tool handle for slidably receiving a drawer or a sliding element therein. The drawer or the sliding element may be used for receiving and storing various kinds of tool members or tool elements or fasteners or tool extensions. However, the tool handle may not be opened such that the tool members and/or the tool elements and/or the fasteners and/or the tool extensions are deeply received in the chamber of the tool handle and may not be easily engaged into and disengaged from the chamber of the tool handle.

The present invention has arisen to mitigate and/or obviate the afore-described disadvantages of the conventional tool handles.

SUMMARY OF THE INVENTION

The primary objective of the present invention is to provide a tool handle including a fully or completely openable configuration for allowing the tool members or tool elements to be easily engaged into and disengaged from the tool handle.

In accordance with one aspect of the invention, there is provided a tool device comprising a base handle member including a front portion having an engaging hole formed therein and including a rear portion, and including an upper portion having a plurality of holes and cavities formed therein, a plurality of tool members detachably and selectively received in the holes and cavities of the base handle member, and a cover handle member including a front portion rotatably secured to the front portion of the base handle member with a pivot axle and movable between an opening position and a closed position, and including a rear portion, and means for selectively latching the rear portion of the cover handle member to the rear portion of the base handle member. The rear portions of the handle members may be opened to a fully open position for allowing the tool members or tool extensions to be easily engaged into and disengaged from the handle members.

The base handle member includes a bulge extended upward from the front and upper portion thereof, the cover handle member includes a notch formed in the front portion thereof for receiving the bulge.

The cover handle member includes a curved inner peripheral wall provided therein and defined by a pair of legs for defining the notch thereof, the bulge of the base handle member includes a curved peripheral surface formed thereon for snugly engaging with the curved inner peripheral wall of the cover handle member when the cover handle member is secured to the base handle member.

The base handle member includes an orifice formed in the front portion thereof, the legs of the cover handle member each includes a pin extended inward of the notch of the cover handle member and rotatably engaged into the orifice of the base handle member for forming the pivot axle and for rotatably securing the cover handle member to the base handle member.

The base handle member includes at least one seat provided on the upper portion thereof, and at least one tool extension selectively and detachably supported on the seat of the base handle member.

One or more driving tool elements may further be provided and may be selectively engaged with the engaging hole of the base handle member for engaging with and for driving the other tool members or fasteners or the like.

The latch means includes an opening formed in the rear portion of the base handle member and includes a catch extended inward of the opening of the base handle member, and a latch slidably engaged in the rear portion of the cover handle member and detachably engaging with the catch of the base handle member.

The cover handle member includes a channel formed in the rear portion thereof, the latch is slidably engaged in the channel of the cover handle member and includes a knob provided thereon for moving the latch to engage with and to be disengaged from the catch of the base handle member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
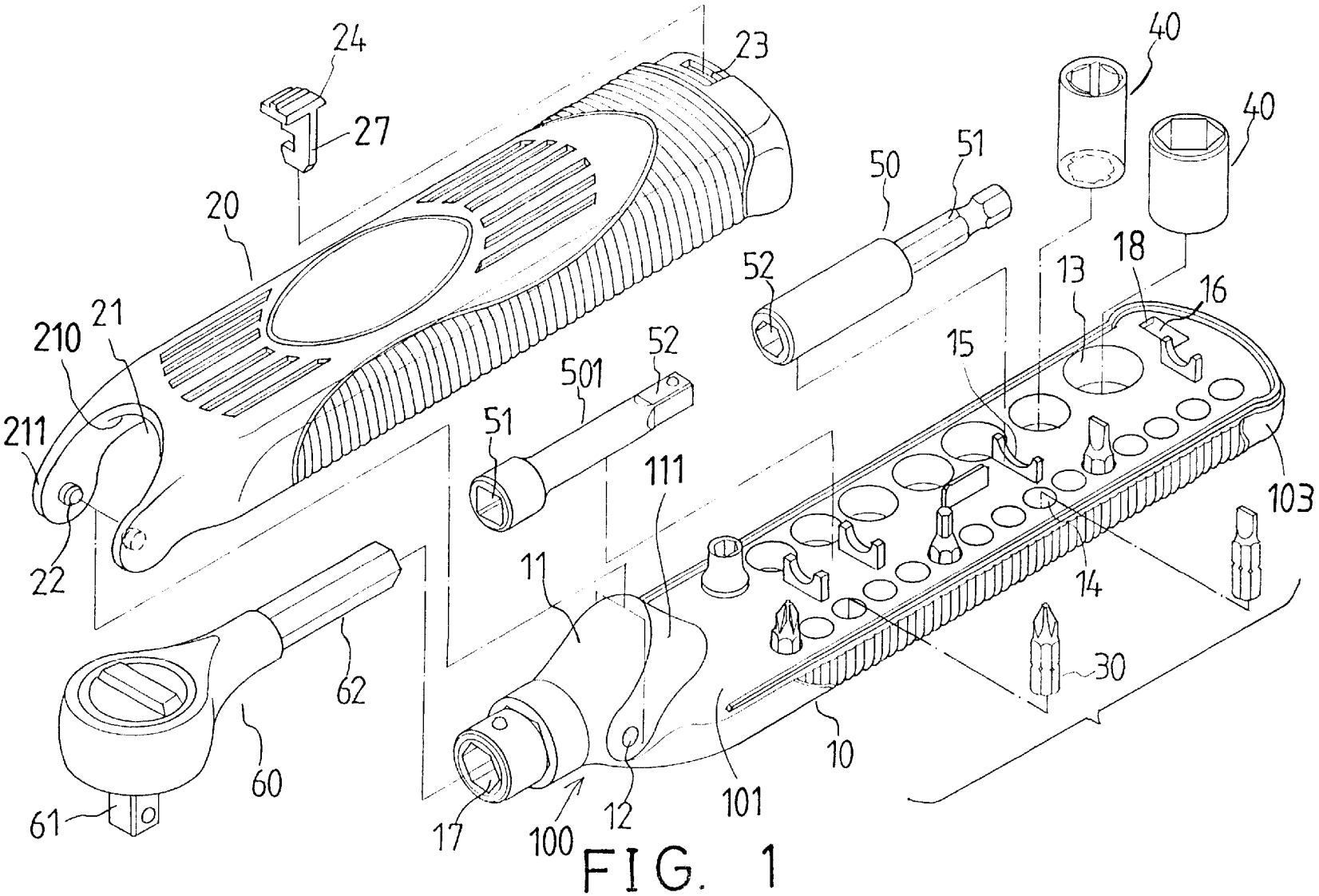
FIG. 1 is an exploded view of a tool handle in accordance with the present invention.
Figure 2:
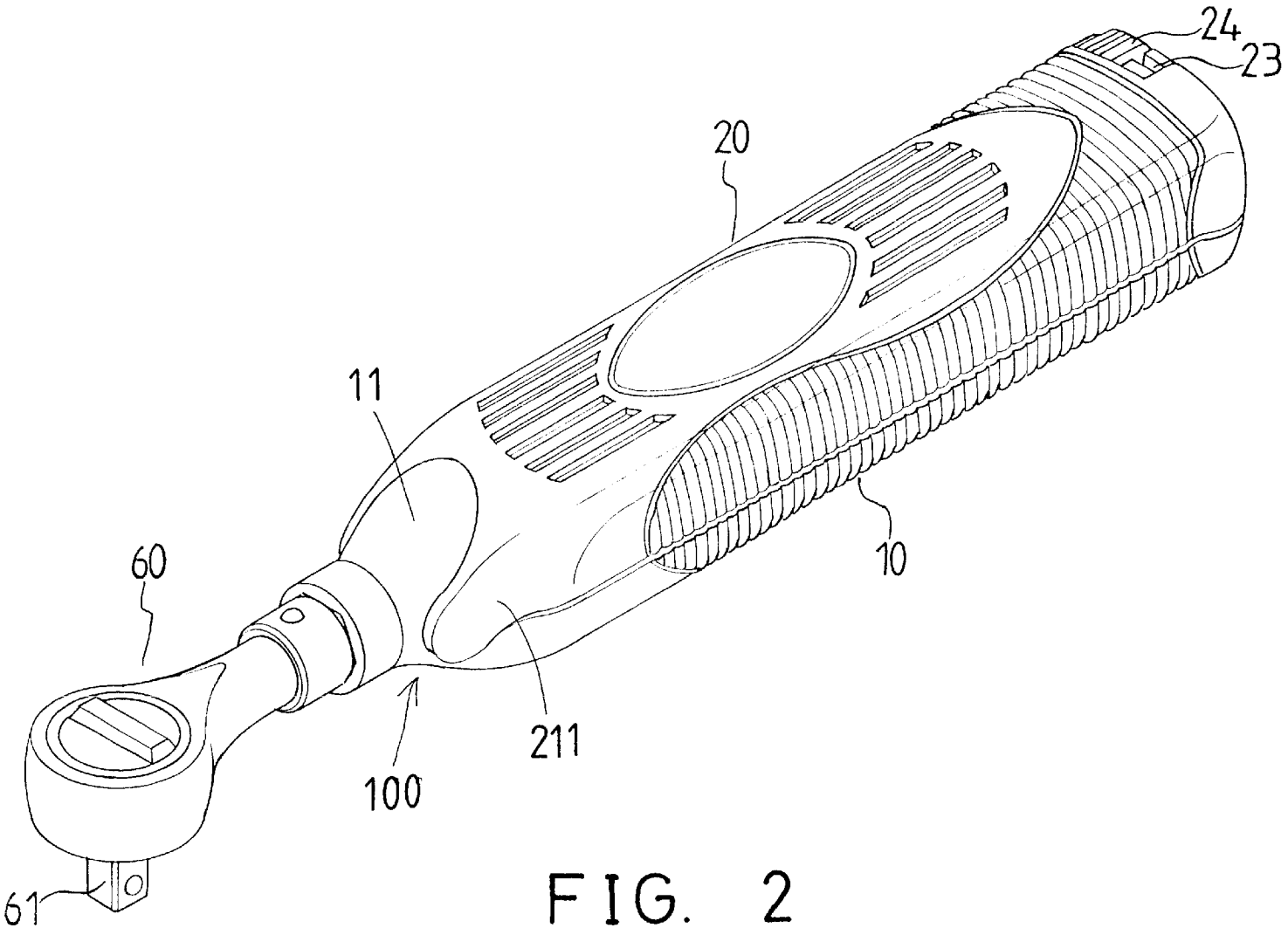
FIG. 2 is a perspective view of the tool handle, in which the tool handle is in a closed position.
Figure 3:
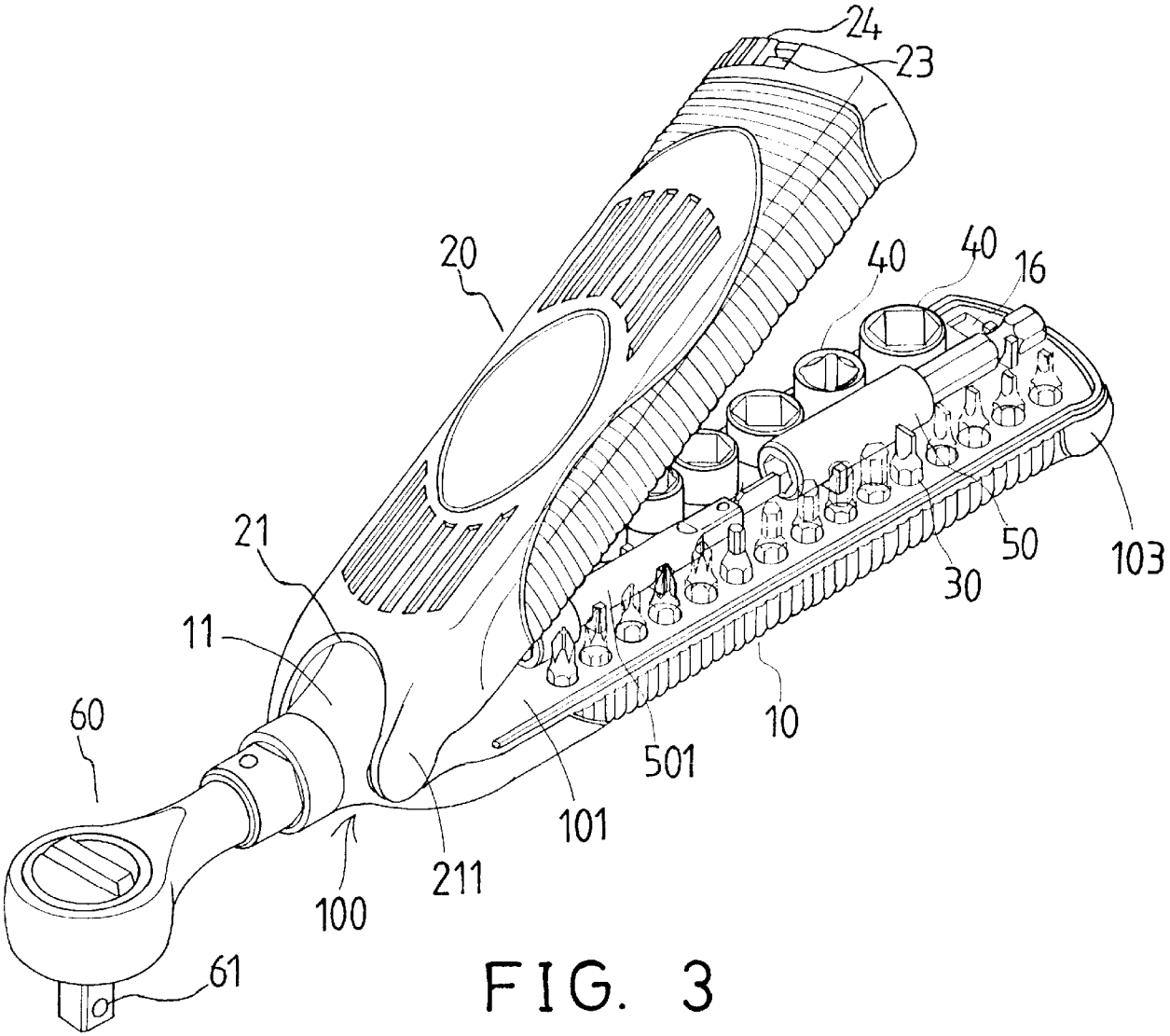
FIG. 3 is a perspective view of the tool handle, similar to FIG. 2, in which the tool handle is in a partial open position.

Referring to the drawings, and initially to FIGS. 1–3, a tool handle in accordance with the present invention comprises a base handle member 10 including a front portion 100 having a bulge 11 extended upward therefrom or extended upward from the upper portion 101 thereof, and having an orifice 12 formed therein. The bulge 11 includes a curved peripheral surface 111 formed in the rear portion and facing rearward and upward. The base handle member 10 includes a number of holes 13 formed in the upper portion 101 thereof for receiving the tool members, such as the sockets 40, and/or the tool elements and/or the fasteners, and includes a number of cavities 14 formed in the upper portion 101 thereof for receiving the tool members, such as the tool bits 30, and/or the tool elements and/or the fasteners, and includes a number of seats 15 formed or provided on the upper portion 101 thereof for retaining the tool members, such as the tool extensions 50, 501 thereon.

Figure 4:
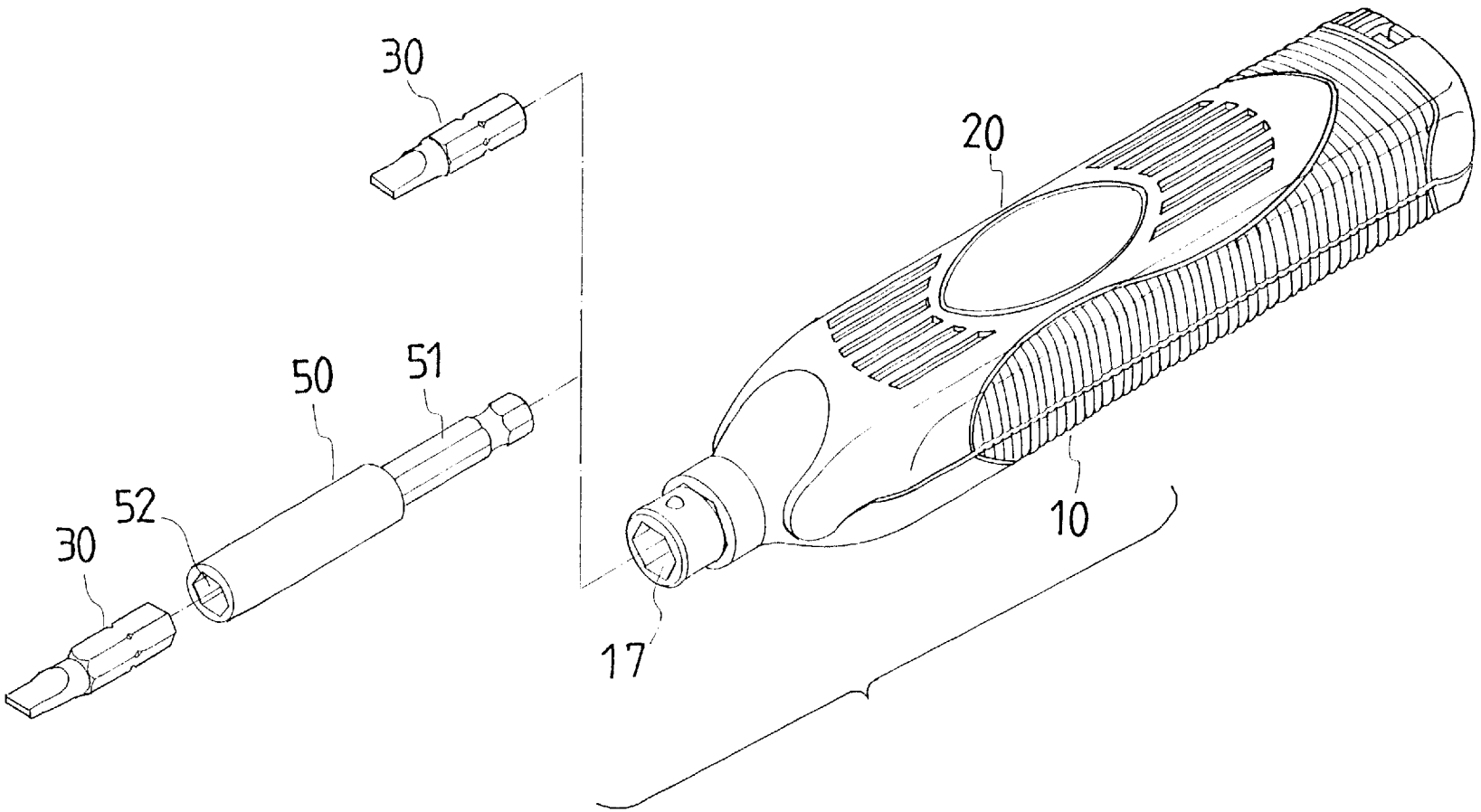
FIGS. 4, 5, 6 are partial exploded views illustrating the operation of the tool handle.
Figure 5:
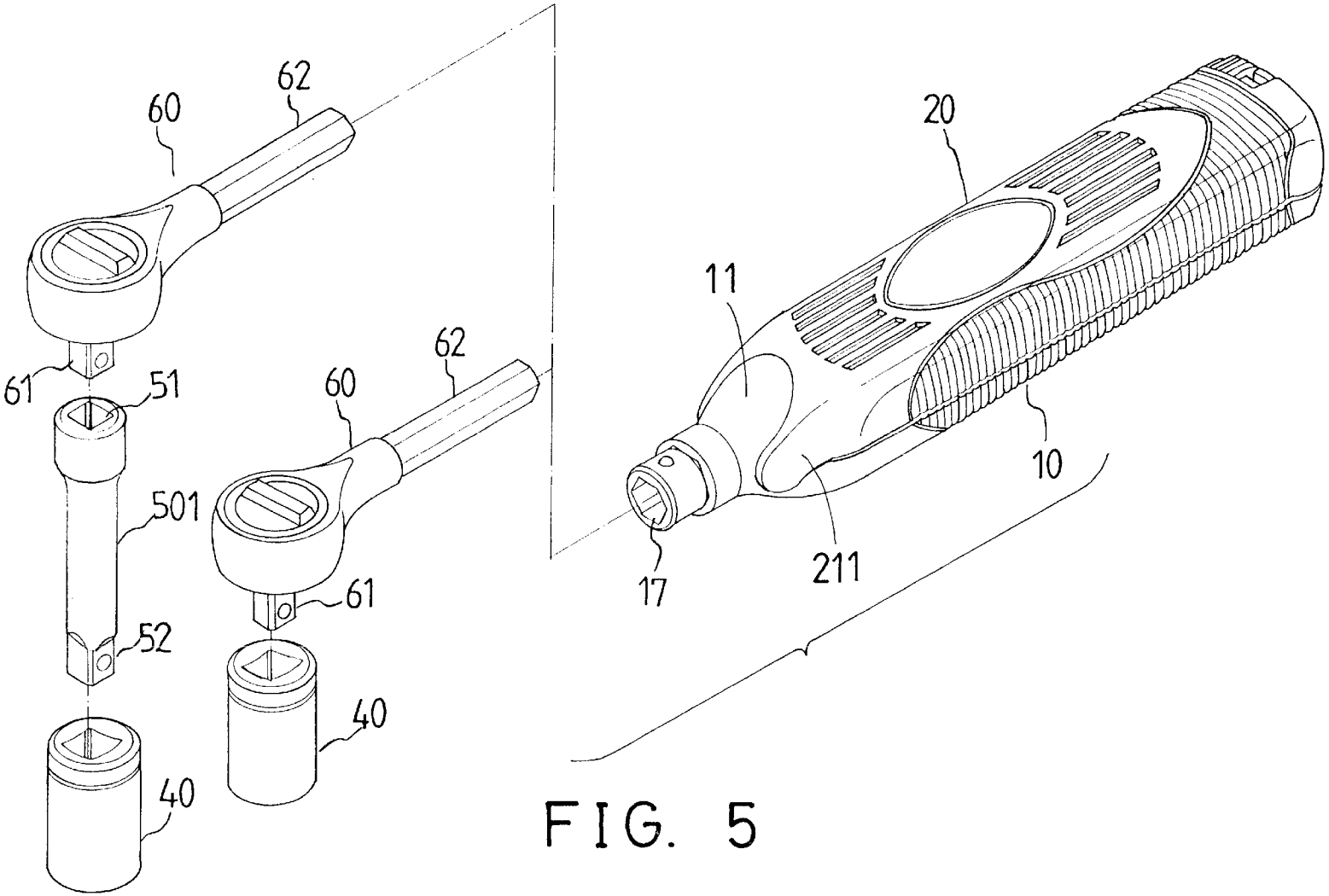
Figure 6:
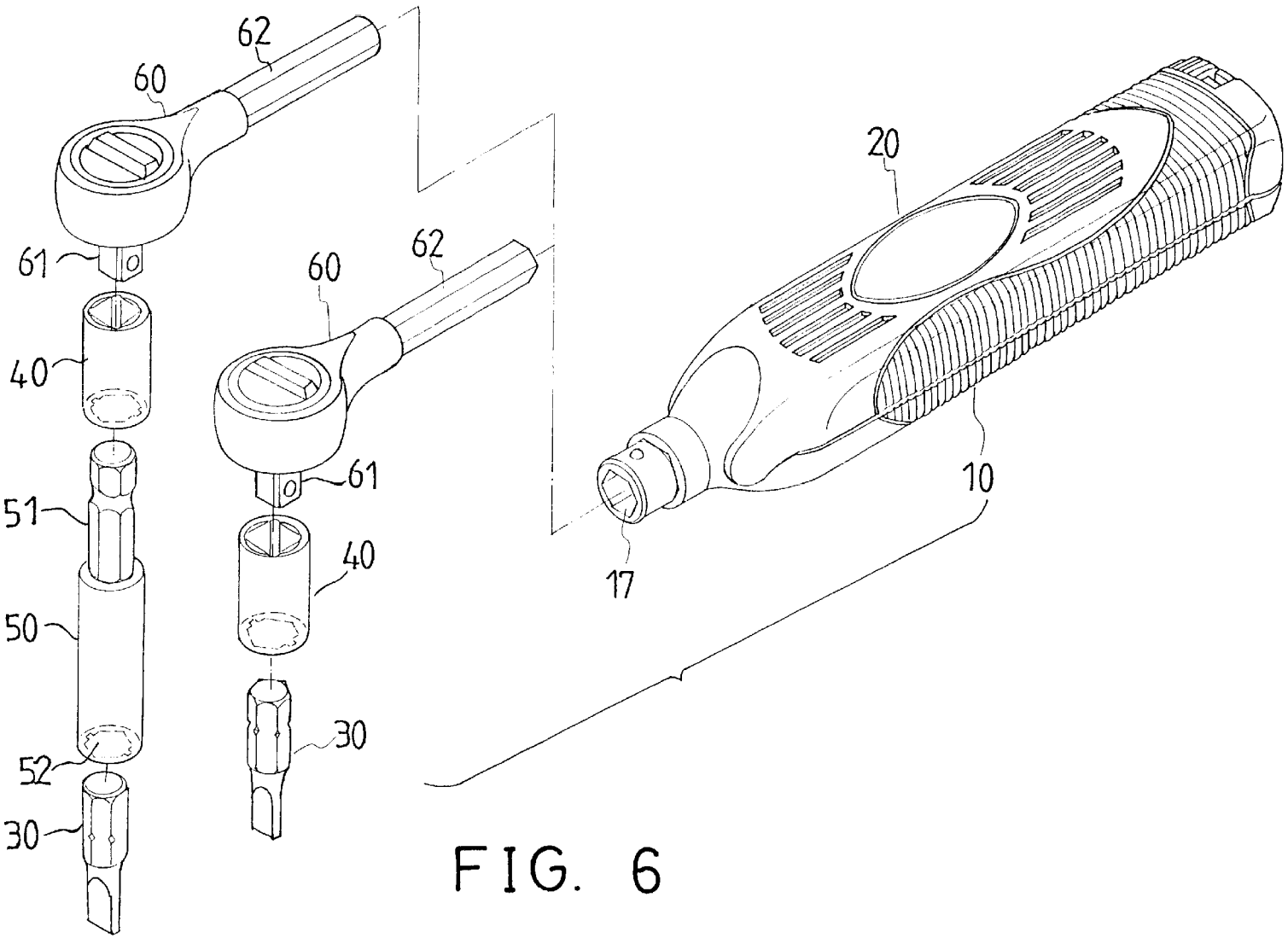

The base handle member 10 includes an engaging hole 17 formed in the front portion 100 thereof, and includes a rear portion 103 having an opening 16 formed therein and having a catch 18 extended inward of the opening 16 thereof. One or more driving tool members 60 each includes a shank 62 for engaging into the engaging hole 17 of the base handle member 10 and for being driven by the tool handle, and includes a ratchet driving device 61 for engaging with the tool bits 30 or the sockets 40 directly or via the sockets 40 (FIGS. 5, 6) or the tool extension 501 (FIG. 5). The shank 51 of the tool extensions 50 may also be directly engaging into the engaging hole 17 of the base handle member 10 (FIG. 4). The tool extension 501 includes an engaging hole 51 formed in one end thereof for receiving the ratchet driving device 61 of the tool member 60 and includes a shank 52 formed on the other end for engaging with the sockets 40 or the other tool extensions 501. The tool extension 50 also includes an engaging hole 52 formed in the end portion thereof for receiving the tool bits 30, the fasteners, the other tool extensions or the like.

A cover handle member 20 includes a front portion having a notch 21 formed therein and defined by a curved inner peripheral wall 210 and/or defined by a pair of legs 211, for receiving the bulge 11 of the base handle member 10. The cover handle member 20 includes a pair of pins 22 extended from the legs 211 respectively and extended inward of the notch 21 of the cover handle member 20 for engaging into the orifice 12 of the base handle member 10 and for forming a pivot axle to rotatably or pivotally secure the cover handle member 20 to the base handle member 10. The curved inner peripheral wall 210 of the cover handle member 20 is snugly engaged onto the curved peripheral surface 111 of the base handle member 10 when the cover handle member 20 is engaged or secured to the base handle member 10.

The cover handle member 20 includes a channel 23 formed in the rear portion thereof corresponding to the opening 16 of the base handle member 10. A knob 24 includes a latch 27 slidably engaged into the channel 23 of the cover handle member 20 and selectively engaged into the opening 16 of the base handle member 10 for selectively engaging with the catch 18 of the base handle member 10 and for selectively securing or locking the cover handle member 20 and the base handle member 10 together. The knob 24 may move the latch 27 to engage with or to be disengaged from the catch 18 of the base handle member 10.

In operation, as shown in FIG. 3, the cover handle member 20 may be rotated relative to the base handle member 10 about the pivot pins 22, between a fully or completely open position and a closed position. The tool members 30, 40 and/or the tool extensions 50, 501 and/or the other tool elements received in the tool handle may be easily engaged into the holes 13 and/or the cavities 14 of the base handle member 10 when the cover handle member 20 is fully opened relative to the base handle member 10. The curved inner peripheral wall 210 of the cover handle member 20 may be snugly engaged onto the curved peripheral surface 111 of the bulge 11 of the base handle member 10 in order to form a suitable sealing configuration and in order to stably retaining the tool members within the handle members 10, 20 when the cover handle member 20 is engaged or secured to the base handle member 10 with the latch 27 of the knob 24.

Accordingly, the tool handle in accordance with the present invention includes a fully or completely openable configuration for allowing the tool members or tool elements to be easily engaged into and disengaged from the tool handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool device comprising:

a base handle member including a front portion having an engaging hole formed therein and including a rear portion, and including an upper portion having a plurality of holes and cavities formed therein, a plurality of tool members detachably and selectively received in said holes and cavities of said base handle member, and a cover handle member including a front portion rotatably secured to said front portion of said base handle member with a pivot axle and movable between an opening position and a closed position, and including a rear portion, and means for selectively latching said rear portion of said cover handle member to said rear portion of said base handle member, said latch means including an opening formed in said rear portion of said base handle member and including a catch extended inward of said opening of said base handle member, and a latch slidably engaged in said rear portion of said cover handle member and detachably engaging with said catch of said base handle member.

2. The tool device according to claim 1, wherein said base handle member includes a bulge extended upward from said front and upper portion thereof, said cover handle member includes a notch formed in said front portion thereof for receiving said bulge.

3. A tool device comprising:

a base handle member including a front portion having an engaging hole formed therein and including a rear portion, and including an upper portion having a plurality of holes and cavities formed therein, said base handle member including a bulge extended upward from said front and upper portion thereof, a plurality of tool members detachably and selectively received in said holes and cavities of said base handle member, and a cover handle member including a front portion rotatably secured to said front portion of said base handle member with a pivot axle and movable between an, opening position and a closed position, and including a rear portion, said cover handle member including a notch formed in said front portion thereof for receiving said bulge, and means for selectively latching said rear portion of said cover handle member to said rear portion of said base handle member, said cover handle member including a curved inner peripheral wall provided therein and defined by a pair of legs for defining said notch thereof, said bulge of said base handle member including a curved peripheral surface formed thereon for engaging with said curved inner peripheral wall of said cover handle member when said cover handle member is secured to said base handle member.

4. The tool device according to claim 3, wherein said base handle member includes an orifice formed in said front portion thereof, said legs of said cover handle member each includes a pin extended inward of said notch of said cover handle member and rotatably engaged into said orifice of said base handle member for forming said pivot axle and for rotatably securing said cover handle member to said base handle member.

5. The tool device according to claim 1, wherein said base handle member includes at least one seat provided on said upper portion thereof, and at least one tool extension selectively and detachably supported on said at least one seat of said base handle member.

6. The tool device according to claim 1 further comprising at least one driving tool element selectively engaging with said engaging hole of said base handle member.

7. The tool device according to claim 1, wherein said cover handle member includes a channel formed in said rear portion thereof, said latch is slidably engaged in said channel of said cover handle member and includes a knob provided thereon for moving said latch to engage with and to be disengaged from said catch of said base handle member.

* * * * *